US007784224B2

(12) United States Patent
Peckham

(10) Patent No.: US 7,784,224 B2
(45) Date of Patent: Aug. 31, 2010

(54) PERMANENT COLUMNAR MULTI-FLOORED OPEN-AIR HOUSING STRUCTURE FOR MANUFACTURED HOMES

(76) Inventor: George Peckham, 6407 S. Indian River Dr., Ft. Pierce, FL (US) 34982

( * ) Notice: Subject to any disclaimer, the term of this patent is extended or adjusted under 35 U.S.C. 154(b) by 514 days.

(21) Appl. No.: 11/754,540

(22) Filed: May 29, 2007

(65) Prior Publication Data

US 2008/0295419 A1 Dec. 4, 2008

(51) Int. Cl.
*E04H 5/00* (2006.01)

(52) U.S. Cl. ..... 52/79.7; 52/79.14; 52/106; 52/236.5

(58) Field of Classification Search ..... 52/79.1, 52/106, 136, 175, 236.3, 67, 79.9–79.14, 52/236.5, 236.7, 236.8
See application file for complete search history.

(56) References Cited

U.S. PATENT DOCUMENTS

| | | | | |
|---|---|---|---|---|
| 2,499,498 | A | 3/1950 | Hammond, Jr. | |
| 3,388,512 | A | 6/1968 | Newman | |
| 3,507,080 | A | 4/1970 | Van Hezik | |
| 3,525,186 | A | 8/1970 | Lombardo | |
| 3,712,007 | A | 1/1973 | Kump | |
| 3,719,012 | A | 3/1973 | Laurent | |
| 3,721,056 | A | 3/1973 | Toan | |
| 3,744,193 | A | 7/1973 | Lau | |
| 3,748,794 | A | 7/1973 | Lorenzi et al. | |
| 3,863,418 | A | 2/1975 | Faucheux | |
| 4,054,014 | A | 10/1977 | van der Lely | |
| 2003/0101680 | A1 * | 6/2003 | Lee | 52/745.2 |

* cited by examiner

*Primary Examiner*—Richard E Chilcot, Jr.
*Assistant Examiner*—William V Gilbert
(74) *Attorney, Agent, or Firm*—IP Authority, LLC; Ramraj Soundararajan; William C. McBeth

(57) ABSTRACT

A permanent columnar multi-floored open air housing structure comprising, in each floor, a plurality of enclosures, each of said enclosures used to house a manufactured home, wherein the manufactured home is in compliance with HUD standards defined in 24 CFR Part 3280. The housing structure additionally comprises a plurality of columns which provide the structural support for each of the floors as well as define the space of each enclosure. Safety walls are provided in between the columns along the perimeter of each floor, while privacy walls are provided in between the columns that separate adjacent enclosures. The heights of the privacy walls and safety walls are selected so that they may perform their desired function while still providing the natural light, ventilation and other benefits of an open air structure.

14 Claims, 2 Drawing Sheets

PERMANENT COLUMNAR MULTI-FLOORED OPEN-AIR HOUSING STRUCTURE FOR MANUFACTURED HOMES

BACKGROUND OF THE INVENTION

1. Field of Invention

The present invention relates generally to the field of structures for housing manufactured homes. More specifically, the present invention is related to a permanent columnar multi-storied housing structure for housing manufactured homes which comprises a plurality of floors, each of the floors being divided into enclosures, each enclosure housing a manufactured home.

2. Discussion of Prior Art

The patent to Lombardo (U.S. Pat. No. 3,525,186) discloses an exemplary multi-story housing structure of the prior art. The housing structure is of reinforced concrete construction and includes a plurality of floors, with each floor divided into a plurality of cubicles for housing mobile homes. The housing structure also has a roof over the top floor. The floors and roof are supported and the cubicles are separated by a plurality of partition walls that extend fully from the floor to the next floor or the roof Doors are provided as means for entering the cubicles from a hallway. The construction using partitions extending fully from floor to floor for structural support and to define the cubicles has several disadvantages. With full walls enclosing the mobile home make adequate ventilation of the cubicle difficult; heat may build up within the cubicle leading to increased air conditioning costs. Leaking gasses may be trapped within the cubicle leading to a potential safety hazard. In addition, the full walls block air flow and natural light and contribute to a claustrophobic feel for residents. The full walls substantially prevent residents from interacting with one another, leading to a feel of isolation. The utilization of full floor to ceiling partition walls also increases the manufacturing cost of the structure.

With these drawbacks of the current construction and design, there is need for a permanent, multi-storied housing structure for manufactured homes that has a substantially open air construction and concurrently protects the homes within.

SUMMARY OF THE INVENTION

The present invention provides for a permanent columnar multi-floored open air housing structure comprising, in each floor, a plurality of enclosures, each of said enclosures used to house a manufactured home. The housing structure additionally comprises a plurality of internal and external columns which provide the structural support for each of the floors. Safety walls are provided along the perimeter of each floor in between the external columns, while privacy walls are provided in between rows of internal columns that separate adjacent enclosures. The heights of the privacy walls and safety walls are selected so that they may perform their desired function while still providing the natural light, ventilation and other benefits of an open air structure.

DESCRIPTION OF THE PREFERRED EMBODIMENTS

Figure 1:
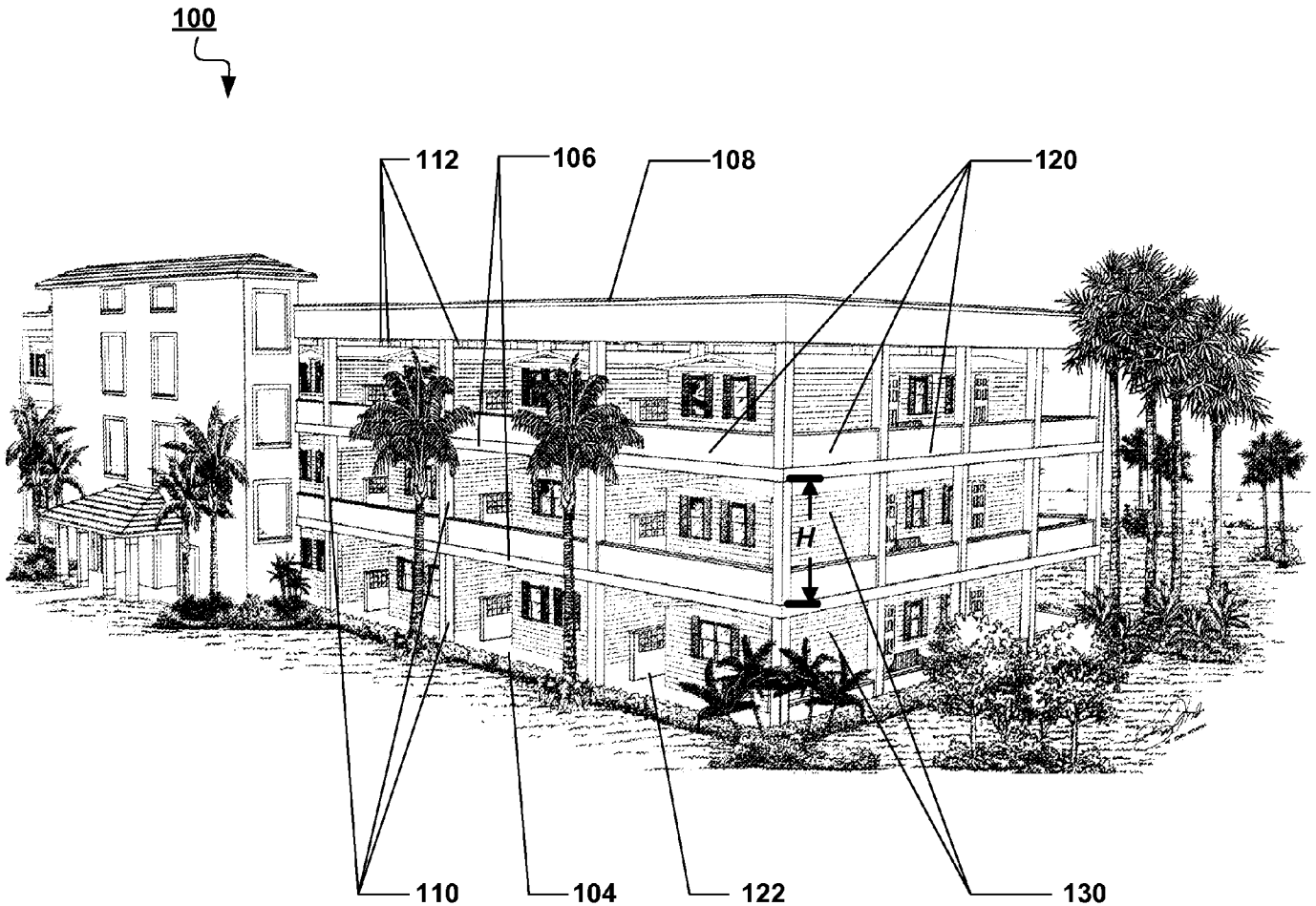
FIG. 1 illustrates an outside view of the permanent columnar multi-floored housing structure of the present invention.

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

The present invention provides for a multi-story, "column supported" permanent structure specifically designed to accommodate and "permanently" house mass produced single family manufactured homes (in compliance, in the United States, with "The National Manufacturing Housing Construction and Standard Act of 1974" including HUD-24 CFR Part 3280) with said single family homes installed into their respective positions, within the permanent structure, for the explicit purpose of providing residencies to meet the Nation's critical demands for lower cost quality housing. The present invention's permanent structure covers and protects both the roof and undercarriage of all permanently installed manufactured homes and utilizes partial walls, railings, or fencing to aid in protecting their sides and the residents within.

The present invention's column supported permanent structure is concrete (with internal reinforcement bar, as required, to achieve structural integrity), as opposed to an all steel structure. This can extend the life of the present invention's permanent structure beyond the life of metal structures by reducing destructive tensile and compressive stresses caused by environmental thermal gradients. Also, concrete permanent structures may not experience destructive surface corrosion rates, caused by varying chemical compositions of the atmosphere, as do steel structures. Additionally, steel structures could experience galvanic structural interface degradation where welds and/or rivets are used for attachment purposes. Concrete structures also provide inherent acoustic dampening effects that metal structures do not provide.

A manufactured home is defined (Federal Reserve Bank of Richmond-USA) as factory built housing that is about 98% complete when transported to the home site. Housing units are normally produced in single wide and double wide sections (In the United States, manufactured homes are Preempted from following state regulations or local building codes because of the chassis substructure that enables transportation and allows interstate travel. In contrast to state regulations and local building codes, which typically prescribe material systems for certain construction types, the HUD Code is performance based and provides only standards for strength, transportability, fire resistance, energy efficiency, and quality conformance. No Manufactured Home may be shipped from the factory unless it complies with the HUD Code and is released for shipment by an independent third-party inspector certified by HUD).

The present invention comprises a system of a Permanent structure containing permanently installed manufactured homes. Not only must the homes within this system meet the aforementioned Governmental requirements, but the combination of these homes permanently installed into the permanent structure of the present invention must recognize and be an extension of these same governmental requirements to insure the safety of all residents. This insures that the present invention's permanent structure is in harmony with all installed manufactured homes and cannot be in conflict with, or negate, any of the aforementioned U.S. Governmental requirements/laws established to protect the safety of homeowners. One typical example of this harmony would be, when (for safety reasons) all manufactured homes are required to have a minimum of two (2) doors for ingress and egress, then the permanent structure that encloses them cannot have less than a minimum of two doors. Every floor of the present invention is designed to be aesthetically pleasing and spacious. This spaciousness is achieved by not having any walls that extend from the floor to the ceiling, for any reason, thereby allowing the floors, ceilings and columns to provide the required structural support for the permanently installed manufactured homes. Each home will have its own private patio, which further enhances the feeling of spaciousness for its occupants, and allows them to enjoy the outdoors. By completely eliminating floor to ceiling walls, and utilizing only columns for vertical support, provides an open atmosphere with many specific/potential benefits.

Some of these benefits are:

Residents are not isolated, or confined, and will have a sense of freedom and well being.

Factors that contribute to claustrophobia, like poorly lit and poorly ventilated enclosed and confining areas, have been addressed and eliminated.

Construction costs are significantly reduced.

Construction building time is significantly reduced.

Natural convective ventilation has been maximized for physical comfort and also reduces costs for all home owners. This maximized natural convective ventilation also insures that potentially explosive gasses (natural gas, etc.) cannot accumulate and explode. Also, the possibility of carbon monoxide poisoning and/or death from cooking on a charcoal grill outside has been essentially eliminated.

Natural lighting from all four sides has been maximized for resident's comfort and physical well being.

Allowing no floor to ceiling walls significantly reduces acoustic reverberation levels to insure resident's comfort and well being.

Residents can easily and comfortably interact with their neighbors if they so desire.

Additionally, by designing the permanent structure to be open, utilizing only columns for vertical support, provides elements of safety and reduced living expenses for all residents that are often times not considered or addressed when multiple family dwellings are designed.

Typical examples:

Should the permanent structure's ingress or egress be blocked by an act of nature, accident, or act of terrorism, all residents have the opportunity to be rescued from anywhere along all four sides of the permanent structure. This will significantly improve the probability of survival should a crisis be encountered.

Should the permanently installed manufactured homes, contained within the permanent structure, have to be expeditiously removed due to a predicted act of nature or act of terrorism, they can be removed from any of the permanent structure's four sides without being restricted by floor to ceiling walls. Also, removal from all four sides could be concurrent to further expedite removal.

The present invention's open design recognizes and addresses the importance of allowing residents to see and interact with their neighbors for both pleasure and safety. One example of this safety aspect would be: if a resident, living alone, had a heart attack at home and became disabled, there is a good possibility that the change in this resident's habit(s) would be noticed by a neighbor, reported and investigated.

Some residents might prefer to have their homes air conditioned during the summer months. By designing the present invention's structure to be "open", thereby maximizing natural convective ventilation, the hot exhaust gas from the air conditioner(s) would not stagnate and thereby increase the temperature of the air surrounding the home. Maximized natural convective ventilation will reduce or eliminate the home owner's potential to waste money on inefficient air conditioning. This design benefit also applies to heated exhausts from clothes dryers.

All home services (water, electric, sewage, etc.) will be centralized and permanently installed to accommodate the permanently installed manufactured homes. To meet the Nation's challenge "To Provide More Affordable & Lower Cost Housing", the present invention's structure will not have, nor need, costly internal mechanisms (lifting devices, cams, pulleys, cables, gears, electric motors, electricity for electric motors, etc.), dedicated to lifting and positioning the manufactured homes into the permanent structure. The elimination of such dedicated internal mechanisms completely eliminates initial procurement costs, installation costs, maintenance costs, "down time" costs and potentially dangerous safety issues associated with machinery. Because all manufactured homes are "permanently" installed and located within the permanent structure, the one-time event of "lifting and locating" of homes will be accomplished by an independent "Rigging Company/Contractor".

All permanently installed manufactured homes, that are located within the permanent structure, must physically be in place with permanent services lines connected, before any "CO" (Certificates of Occupancy) can be issued. This insures that no resident will be subjected to the possibility of an accident during the installation process. All permanent structures and manufactured homes (defined above) individually or in combination may have varying: (a) external dimensions, (b) number of floors, (c) number, size, type, make and orientation of manufactured homes, (d) color and surface texture, (e) material composition, (f) size, number/type/make and location of stairways and elevators, (g) floors, partial walls, and ceiling treatment, and (h) orientation of the permanent structure.

The present invention's structure is designed to provide the public with a unique and enjoyable housing and living experience and concurrently meet the nation's demands for lower cost quality housing. The present invention's structure will provide homeowners with outstanding opportunities and benefits that presently do not exist. These opportunities and benefits include, but are not limited to: (1) conservation of land, (2) conservation of energy, (3) conservation of materials and natural resources, (4) reduced cost of land, (5) reduced utility expenses, (6) reduced environmental hazards, (7) reduced depreciation, (8) reduced mortgage rates, (9) reduced insurance rates, (10) reduced housing costs, (11) reduced living costs, (12) reduced construction time, (13) reduced crime, (14) reduced emergency response time, (15) increased resale value, and (16) increased number of potential homeowners.

A brief description of these opportunities and benefits are as follows:

1. Conservation of Land—Significantly more manufactured homes can be located on a finite piece of property with the present invention's structure than can be conventionally located on the ground. A typical example illustrating the potential magnitude, of this conservation of land, is that a two or six story structure based on the teachings of the present invention would require, respectively, 50% to 83% less land per living unit. Therefore, future generations will have the opportunity to enjoy more unused and unaltered land. Less land usage for housing will also benefit our ecology.

2. Conservation of Energy—The present invention's structure has the ability to save significant amounts of energy and reduce U.S. dependence upon foreign oil. This energy savings is realized because the manufactured homes are contained and protected within the permanent structure. One example of this energy savings would be to have the present invention's structure located in the southern part of the United States. In this example, the sun is unable to shine directly upon the roof or the full sides of the enclosed homes, thereby significantly reducing the amount of energy required for air conditioning. This savings also applies to the present invention's structure located in the northern part of the United States, but the savings there would be less significant. Additionally, the natural convective air inside the present invention's permanent structure is cooler than outside ambient air further assisting in reducing energy requirements. Conversely, similar homes located conventionally on the ground have the sun shining on them almost all day long. Another example of energy savings would be when the present invention's structure is located in the northern part of the United States where there is snow, sleet and cold or freezing winds in the winter. In this example, there would almost never be snow or ice in intimate contact with the manufactured homes contained within the permanent structure. Also, the permanent structure's low walls protecting the manufactured homes, reduces the cold wind speed prior to impacting upon the walls of the homes within. This reduced wind speed carries away less heat, than if there were no walls (like homes conventionally located on the ground) and thereby further reducing energy requirements.

3. Conservation of Materials—Because the present invention's permanent structure provides substantial protection to the homes contained within, there is essentially no reduction in the life of the homes caused by natural external elements like wind, snow, sun, rain or sleet. Therefore, the life expectancy of manufactured homes is significantly extended far beyond those unprotected manufactured homes conventionally located on the ground. This longer life of the homes extrapolates into large material savings because replacement of homes due to external deterioration will be an insignificant issue.

4. Reduced Cost of Land—As previously stated (see 1), living in the present invention's structure requires less land per living unit. Again, this is because more manufactured homes can be located vertically upon a finite piece of land than is possible for homes conventionally located upon the ground. Also, using as an example a two and six story structure based on the present invention's teachings, the approximate reduction in unit land cost ($s) is: 50% for a two story structure and 83% for a six story structure. The percentage of savings for "reduced cost of land" is approximately equal to the percentage of "conservation of land" savings.

5. Reduced Cost of Utilities—The homeowner's utility expenses will be substantially lower than the utility expenses of a similar home conventionally located on the ground. This reduced utility expense is achieved because all modular/pre-constructed homes in the present invention's structure are significantly protected from the elements (sun, wind, rain, snow, sleet, etc.) by the permanent structure they are housed in. This means, as an example, that during the summer months, these homes will have very little or no direct sunlight on them. This significant reduction of sunlight reduces the energy requirement(s), and utility costs, associated with air conditioning. Also, in the winter, the permanent structure will allow less wind to enter any passages, opening or cracks that may exist in the manufactured homes and thereby reduce a potential "cool down" effect. Additionally, any home trying to generate heat and maintain a set temperature above the outside ambient temperature, will be less negatively affected by the external cooling power of cold or freezing wind because less wind and slower wind will impinge upon the protected home. This will significantly reduce energy requirements and utility costs associated with heating these homes.

6. Reduced Environmental Hazards—Residents residing in the present invention's structure will be physically safer from natural elements/disasters such as storms, wind, rain, sleet, snow, sun and ice, than residents living in manufactured homes conventionally located on the ground. The present invention's permanent structure provides protection to the roof, undercarriage and sides of the homes contained within. This protection reduces and/or eliminates wind damage, slipping and falling on ice or snow, electrical hazards, etc.

7. Reduced Depreciation—In addition to the present invention's permanent structure substantially protecting the enclosed manufactured homes from nature's elements (wind, snow, sun, sleet, rain, etc.) and thereby providing homeowners with energy savings (see 2), material savings (see 3), utility savings (see 5), and improved safety (see 6), it will also significantly reduce the depreciation rate of the protected homes. The initial depreciation for newly purchased manufactured homes is approximately 12% regardless of where the home is to be located. But after that initial depreciation loss, homes that are placed conventionally on the ground will depreciate at a much faster rate than that same home located in the present invention's structure.

8. Better Mortgage Rates and Terms for Homeowners—Better mortgage rates and terms can be anticipated by home owners because of the following: (a) The present invention's permanent structure has a life expectancy equal to conventional condominiums and history has shown that most permanent structures (buildings) appreciate with time, which means that a significant part of the homeowner's mortgage collateral appreciates, making the loan more secure. (b) The manufactured homes contained within the present invention's permanent structure are protected from nature's elements (wind, rain, sun, snow, sleet, etc.) to the extent that they will depreciate (see 7) much slower than their counterparts conventionally located on the ground. Homes in the present invention's structure, located and protected in their permanent structure, may depreciate at a rate slower or equal to the rate of inflation, thereby further enhancing the loan collateral. (c) The value of land, upon which the present invention's structure is located, is also expected to increase, based upon historical land prices, thereby again, improving the loan collateral and making it even more secure. (d) Knowing that the residents and their homes are located in a permanent structure that provides additional physical safety (see 6) and protection for both residents and homes (than homes conventionally located on the ground) further enhances the ability of the homeowners to obtain more attractive mortgages. (e) Other important considerations (beneficial to the lending institution) to be considered are: Less potential for random crime (see 13), homeowners paying reduced Insurance Rates (see 9), and reduced homeowner's utility costs (see 5). Less cost for insurance and utilities for homeowners mean homeowners are less of a financial risk than their counterparts with homes conventionally located on the ground. Lastly, because the present invention's permanent structure must be in harmony with all Governmental requirements for installed manufactured homes, lending institution will not have to worry about sub-standard or dangerous housing being or becoming a part of the present invention's structure.

9. Reduced Insurance Rates—Because the present invention's permanent structure provides physical protection to residents and their homes, homeowner's insurance rates for these homes will be lower than their counterpart homes that are conventionally located on the ground.

10. Reduced Housing Costs—The present invention's structure provides the opportunity for all manufactured homes, placed into the present invention's permanent structure, to be built and sold for lower prices than are presently available, thereby providing more people the opportunity to become home owners. These reduced home acquisition costs can be achieved by: (a) All homes can have their roofs changed from pitched to flat when being built by the manufacturer (with prior governmental approval), thereby providing a roof that costs less money to produce but still meets the necessary safety standards. (b) All manufactured homes sold in the northern part of the U.S. have heavier, stronger, and more expensive vertical support structures and roofs (Government requirement) to withstand snow and ice loads. These heavier, stronger and more expensive construction requirements will not be necessary if the manufactured homes are being manufactured to be placed within the present invention's permanent structure because the permanent structure insures that all homes, contained within, are never subjected to snow or ice loading. This change would also require Government concurrence. (c) All manufactured homes built in the U.S., must be built to Government standards for the zone (3 zones in the U.S.) into which it will be placed. Homes being placed into different zones have individual construction requirements that they must comply with. There is a good possibility that the present invention's protective permanent structure would allow all modular/pre-constructed homes to be built to one manufacturing standard regardless of what zone they will be used in. This possibility can provide the opportunity to standardize production methods for all 3 zones and further reduce production and acquisition costs.

11. Reduced Living Costs—Homeowners of the present invention's structure can enjoy reduced living costs/expenses due to many factors. Some of these factors include, but are not limited to, the following: (a) reduced external repair and maintenance (see 3) to their homes because of the protection provided by the permanent structure. (b) Utilities will cost less (see 2) because of the permanent structure's ability to reduce and conserve energy related to heating and cooling of their homes. (c) Less money needs to be put aside, to pay for storm damage (see 6) because the permanent structure significantly reduces the potential for, and severity of, storm damage. (d) Reduced mortgage rates (see 8) means less money is needed for mortgage payments. (e) Less money is needed to pay reduced insurance (see 9) premiums. All of the aforementioned reductions in living costs/expenses provides a more financially stable, secure and satisfied homeowner.

12. Less Construction Time—The present invention's structure takes less time to construct and house people than conventional apartment buildings or condominiums. While the present invention's permanent structure is being constructed, the manufactured homes that will be placed inside the permanent structure can concurrently be built thereby accelerating the "ready for occupancy" process.

13. Reduced Crime—The present invention's structure is a permanent multi-story structure safeguarding manufactured homes contained within from anticipated random crime in an easier manner than with similar homes conventionally located on the ground. The present invention's structure has more units per square foot and is easier to oversee and protect because all residents and visitors must enter and exit from a central location that is easily observed and controlled. Because ingress and egress locations (elevators/stairs) are permanently and conveniently located for all residents, the ability to monitor and control these entrances and exits is simplified. One available deterrent to random crime would be to require a key to operate the elevator(s) and door(s) leading to the stairwell(s), with all residents having their own keys. The final decision relative to what security method will be incorporated into the present invention's structure would be decided by the builder, but that decision can not reduce or eliminate any governmental requirements for any modular/pre-constructed homes.

14. Reduced Emergency Response Time—The present invention's structure allows local and national agencies to respond more rapidly to emergencies or special circumstances, when and where safe, permanent, responsible and reasonably priced housing is desperately needed. The present invention's structure allows for the construction of the permanent structure while concurrently having modular/pre-constructed houses being built at a multitude of government approved manufacturing sites in many different states that are already established. The present invention's structure can fill the gap between providing temporary housing and providing conventionally constructed concrete or wood frame housing.

15. Increased Resale Value—Because the manufactured homes are housed within the permanent structure, these homes are protected from destructive natural elements such as sun, wind, rain, snow, and sleet. Similar homes, conventionally located on the ground, do not enjoy these protective benefits. The protected homes of the present invention's structure, therefore, have an extended life, and their resale value is significantly greater than the resale value of their counterparts located on the ground. This means that homeowners can sell their homes for more money and receive a higher return on their modular/pre-constructed home investment.

16. Increased Number of Potential Homeowners—The present invention's structure provides a new and unique opportunity for additional citizens to become homeowners and enjoy a lifestyle that presently does not exist. The present invention's structure recognizes, combines and addresses these presently non-existent opportunities and benefits, and delivers an unprecedented new style of living that will increase the number of homeowners in the country. Some of these additional opportunities and benefits are: (a) People can become a home owner knowing and appreciating the fact that the lifestyle they have selected contributes to the conservation of land, which is one of the country's limited resources. (b) Because the present invention's structure requires less land for a given number of living units than conventional housing, the cost of the land per unit is significantly reduced, which make the land more affordable for potential homeowners. (c) People who are concerned about random crime will consider investing in a home, even though these same people refuse to invest in a similar home conventionally located on the ground. (d) People who are concerned about their physical safety, and refuse to live in modular/pre-constructed homes located on the ground, will consider living in a home housed in the present invention's structure. (e) People who refuse to purchase manufactured homes, conventionally located on the ground, because of their low resale value will consider buying a home (housed in the present invention's structure) that will have a higher resale value. (f) Insurance rates for homes housed within the present invention's structure will be less than a similar home conventionally located on the ground. (g) Homes in the present invention's structure are less expensive than conventional condominiums. (h) Knowing that homes in the present invention's structure provide adequate natural lighting, excellent natural convective ventilation and non-claustrophobic surroundings will also be an additional enticement for people to buy homes located in the present invention's structure. (i) Conservation of energy is another consideration for home owners. When potential home owners recognize that living in the present invention's structure will require less energy, to power their homes, than a similar home conventionally located on the ground, they will give additional consideration to purchasing a home in the present invention's structure because reduced energy requirements means reduced utility expenses. As an additional benefit, some potential homeowners would correctly equate reduced energy requirements associated with homes in the present invention's structure, to reduced reliance upon foreign oil. (j) Reduced mortgage rates and better mortgage terms, due to the protection afforded all homes within the present invention's permanent structure, will also be a positive factor to increase homeownership.

As illustrated in FIG. 1, permanent columnar multi-floored open air housing structure 100 comprises ground floor 104 at ground level as well as additional floors 106 above the ground floor. In FIG. 1, structure 100 has two additional floors 106, but it is understood that any number of additional floors may be used without departing from the scope of the present invention. The additional floors are supported by a combination of external columns 110, disposed around the perimeter of floor 106, and internal columns 112, disposed within the perimeter of floor 106. Each of the external and internal columns is of height H, which may vary between 108" and 360", and are disposed at design dictated intervals. Additionally, the top floor is provided with roof 108 also supported by a combination of internal and external columns. All of the floors, columns and the roof are made of concrete. The construction and dimensions of permanent columnar multi-floored open air housing structure 100 are selected to specifically accommodate homes that are in compliance with The National Manufacturing Housing Construction and Standard Act of 1974 including HUD-24 CFR Part 2380.

Figure 2:
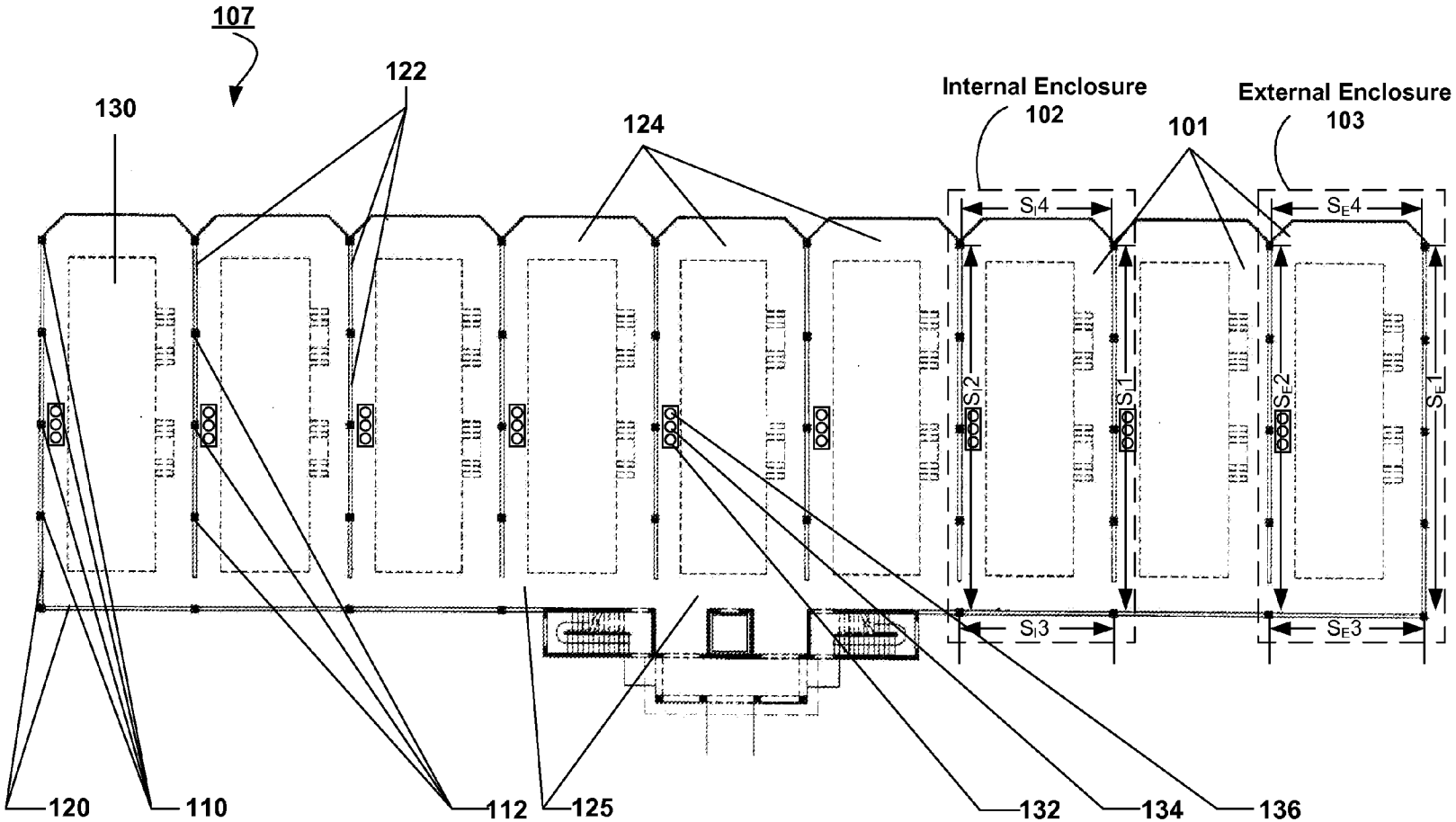
FIG. 2 illustrates a top view of an exemplary floor plan of one floor of the permanent columnar multi-floored structure of the present invention.

As more clearly shown in FIG. 2, external columns 110 are disposed along the periphery of structure 100 while internal columns 112 are disposed along the interior of the structure as dictated by design. As also shown in FIG. 2, enclosures 101 are defined by privacy walls 122 which divide the floor space of exemplary floor 107. Ground floor 104 and additional floors 106 have the same layout and structure as exemplary floor 107. In this figure, a row of nine enclosures 101 is illustrated, however, it is understood that the row of enclosures may contain any number of enclosures without departing from the scope of the present invention. Each enclosure 101 provides the space to house one manufactured home 130. Preferably, the enclosure has the size to accommodate either a single, double, or triple wide manufactured home. Each enclosure 101 is provided with water 132, sewage 134, and electrical 136 service line connections for the manufactured home. Also, each enclosure may provide patio area 124 for the manufactured home. Enclosures 101 are further differentiated as being either internal enclosures 102 or external enclosures 103, with the internal enclosures defined as enclosures being located in the interior of the row, and sharing two sides with two adjacent enclosures. External enclosures are located on the two ends of the row of enclosures, and share only one side with one adjacent enclosure.

In the embodiment illustrated in FIG. 2, each internal enclosure has four sides, $S_I$1-$S_I$4, while each external enclosure has four sides $S_E$1-$S_E$4. As shown, sides $S_I$1 and $S_I$2 of an interior enclosure are of equal length while sides $S_I$3 and $S_I$4 are of equal length giving the internal enclosure a rectangular shape. Similarly, sides $S_E$1 and $S_E$2 of an external enclosure are of equal length while sides $S_E$3 and $S_E$4 are of equal length giving the external enclosure a rectangular shape. As also illustrated, side $S_I$1 of an internal enclosure and side $S_E$1 of an external enclosure are of equal length while side $S_I$3 of an internal enclosure and side $S_E$3 of an external enclosure are also of equal length. In the embodiment illustrated, all enclosures 101 are of equal size whether they are internal enclosures 102 or external enclosures 103, and therefore, each of the enclosures is designed to accommodate the same size manufactured home. However, it is envisioned that the size of the enclosures on any given floor may be varied to accommodate single wide, double wide, and triple wide manufactured homes within the permanent columnar multi-floored open air housing structure 100.

Continuing with FIG. 2 safety walls 120 are disposed along the perimeter of floor 106 in every space between external columns 110. Each safety wall is approximately between 38" and 48" in height and extends completely between two external columns. As also shown in FIG. 2, common walkway 125 extends completely along one side of the perimeter of floor 104 just on the inside of external columns 112 and safety walls 120. In addition, privacy walls 122 are disposed between the columns along the sides of enclosures 101 that are shared with adjacent enclosures, except for the space occupied by walkway 125. The height of the privacy walls is not to exceed 0.67H of the internal and external columns. In a preferred embodiment, the privacy walls are 72" in height. The heights of the privacy walls between enclosures and the safety walls along the perimeter of the floor are selected to provide a substantially open air housing structure for accommodating manufactured homes 130.

CONCLUSION

Disclosure has been provided for the effective implementation of a permanent columnar multi-floored housing structure. While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by size, materials, or specific manufacturing techniques.

The invention claimed is:

1. A permanent columnar multi-storied open air housing structure made from concrete comprising, a plurality of stories, each story comprising a plurality of columns of height H disposed around a perimeter of each story as well as a plurality of columns of height H disposed within said perimeter of each story, each story having a plurality of enclosures, each enclosure housing a manufactured home, each enclosure comprising:

a plurality of sides, wherein at least one side is shared with an adjacent enclosure and the remaining sides are disposed along said perimeter of said story; at least one privacy wall, said privacy wall disposed between the columns located along said side that is shared with an adjacent enclosure;

at least one safety wall, said safety wall disposed between said columns located along said side that is disposed along said perimeter of said story;

wherein said at least one privacy wall has a height that does not exceed 0.67H;

wherein said safety walls and said privacy walls extend completely between said respective columns, said structure comprising water, sewage, and electrical service line connections disposed within each of said enclosures and wherein said multi-storied open air housing structure enhances natural convective ventilation of said enclosures and the manufactured homes disposed therein.

2. The housing structure of claim 1, wherein said privacy wall has a height of 72".

3. The housing structure of claim 1, wherein said safety wall has a height selected to be in the range between 38" and 48".

4. The housing structure of claim 1, further comprising a common walkway disposed along a side of said story perimeter.

5. The housing structure of claim 1, further comprising a patio area disposed within each of said enclosures.

6. A permanent columnar multi-storied open air housing structure made from concrete comprising, a plurality of stories, each story comprising, a plurality of columns of height H disposed around a perimeter of each story as well as a plurality of columns of height H disposed within said perimeter of each story, each story having a plurality of enclosures, each enclosure receiving a manufactured home, each enclosure comprising either an external enclosure or an internal enclosure, and:

a. said external enclosure comprising:

1. a first side, which is shared with an adjacent enclosure, formed by at least one first privacy wall, each first privacy wall disposed between a pair of columns located along said first side, wherein said first privacy wall has a height that does not exceed 0.67H;
2. a second side formed by at least one safety wall, each safety wall disposed between a pair of columns located along said second side;

b. said internal enclosure comprising:

1. a first side, which is shared with an adjacent enclosure, formed by at least one second privacy wall, each second privacy wall disposed between a pair of columns located along said first side, wherein said second privacy wall has a height that does not exceed 0.67H;
2. a second side, which is shared with an adjacent enclosure, formed by at least one third privacy wall, each third privacy wall disposed between a pair of columns located along said second side, wherein said third privacy wall has a height that does not exceed 0.67H;

wherein said safety walls and said privacy walls extend completely between said respective columns, and said structure comprising water, sewage, and electrical service line connections disposed within each of said enclosures; and wherein said internal and external enclosures house a manufactured home of a pre-determined dimension; and wherein said multi-storied open air housing structure enhances natural convective ventilation of said enclosures and the manufactured homes disposed therein.

7. The housing structure of claim 6, wherein said columns are disposed at regular intervals.

8. A permanent columnar multi-storied open air housing structure made from concrete comprising a plurality of stories, each story having, a plurality of columns of height H disposed around a perimeter of each story, as well as a plurality of columns of height H disposed within said perimeter of each story, each story having a plurality of enclosures, each enclosure comprising either an external enclosure or an internal enclosure, and:

a. said external enclosure comprising:

1. a first side, which is shared with an adjacent enclosure, formed by at least one first privacy wall, each first privacy wall disposed between a pair of columns located along said first side, wherein said first privacy wall has a height that does not exceed 0.67H;
2. a second side formed by at least one first safety wall, each first safety wall disposed between a pair of columns located along said second side;
3. a third side formed by at least one second safety wall, each second safety wall disposed between a pair of columns located along said third side;
4. a fourth side formed by at least one third safety wall, each third safety wall disposed between a pair of columns located along said fourth side;

b. said internal enclosure comprising:

1. a first side, which is shared with an adjacent enclosure, formed by at least one second privacy wall, each second privacy wall disposed between a pair of columns located along said first side, wherein said second privacy wall has a height that does not exceed 0.67H;
2. a second side, which is shared with an adjacent enclosure, formed by at least one third privacy wall, each third privacy wall disposed between a pair of columns located along said second side, wherein said third privacy wall has a height that does not exceed 0.67H;
3. a third side formed by at least one fourth safety wall, each fourth safety wall disposed between a pair of columns located along said third side;

4. a fourth side formed by at least one fifth safety wall, each fifth safety wall disposed between a pair of columns located along said fourth side;

wherein said safety walls and said privacy walls extend completely between said respective columns, said structure comprising water, sewage, and electrical service line connections disposed within each of said enclosures wherein said internal and external enclosures house a manufactured home of a pre-determined dimension; and wherein said multi-storied open air housing structure enhances natural convective ventilation of said enclosures and the manufactured homes disposed therein.

9. The housing structure of claim 8, wherein said privacy wall has a height of 72".

10. The housing structure of claim 8, wherein said safety wall has a height selected to be in the range between 38" and 48".

11. The housing structure of claim 8, wherein said columns are disposed at regular intervals.

12. The housing structure of claim 8, further comprising a common walkway disposed along a side of said perimeter of said story.

13. The housing structure of claim 8, further comprising a patio area disposed within each of said enclosures.

14. The housing structure of claim 8, wherein each enclosure is sized to accommodate a single wide, double wide, or triple wide manufactured home.

* * * * *